United States Patent [19]

Ohta

[11] 4,102,306

[45] Jul. 25, 1978

[54] DEVELOPING ROLLER AND RINSING DEVICE

[75] Inventor: Tatsuo Ohta, Hachioji, Japan

[73] Assignee: Konishiroku Photo Industry Co., Ltd., Tokyo, Japan

[21] Appl. No.: 795,629

[22] Filed: May 10, 1977

[30] Foreign Application Priority Data

May 31, 1976 [JP] Japan ..... 51-62401
May 31, 1976 [JP] Japan ..... 51-62402

[51] Int. Cl.[2] ..... G03G 21/00; G03G 15/10; G03G 15/09

[52] U.S. Cl. ..... 118/658; 118/645; 118/652; 118/661

[58] Field of Search ..... 118/658, 645, 661, 662, 118/652, 657, 659, 660

[56] References Cited

U.S. PATENT DOCUMENTS

| | | | |
|---|---|---|---|
| 3,064,622 | 11/1962 | Thompson | 118/662 |
| 3,322,048 | 5/1967 | Fauser et al. | 118/661 |
| 3,384,051 | 5/1968 | Hunstiger | 118/652 |
| 3,405,683 | 10/1968 | Jons et al. | 118/661 X |
| 3,592,675 | 7/1971 | Cheng | 118/652 X |
| 3,640,248 | 2/1972 | Nielander | 118/658 |
| 3,641,969 | 2/1972 | Hakanson | 118/658 X |
| 3,724,422 | 4/1973 | Latone et al. | 118/658 |
| 3,739,749 | 6/1973 | Kangas et al. | 118/658 |
| 3,839,071 | 10/1974 | Bonelli et al. | 118/645 X |
| 3,839,992 | 10/1974 | Takahashi | 118/657 X |
| 3,910,231 | 10/1975 | Inoue et al. | 118/645 |
| 3,913,524 | 10/1975 | Fukushima | 118/662 X |
| 3,916,830 | 11/1975 | Kojima et al. | 118/658 |
| 3,939,801 | 2/1976 | Tanaka et al. | 118/658 |
| 3,965,861 | 6/1976 | Fukushima et al. | 118/661 X |
| 3,970,042 | 7/1976 | Rees | 118/645 |
| 3,985,099 | 10/1976 | Nagashima et al. | 118/658 |
| 3,999,511 | 12/1976 | Schwandt et al. | 118/661 X |

*Primary Examiner*—Mervin Stein
*Assistant Examiner*—Andrew M. Falik
*Attorney, Agent, or Firm*—Lane, Aitken, Dunner & Ziems

[57] ABSTRACT

In an electrophotographic apparatus, there is disclosed a developing device and a rinsing device which use an improved roller. The roller comprises a stationary magnetic member including a plurality of magnetic poles, a non-magnetic rotatable member provided around the magnetic member so as to rotate along the outer periphery of the magnetic member, and a magnetic brush of magnetic particles formed on the outer surface of the rotatable member. By rotation of the rotatable member, the magnetic brush, which is imbued with a developing or rinsing liquid, will feed the liquid to the developing section or the rinsing section.

8 Claims, 4 Drawing Figures

DEVELOPING ROLLER AND RINSING DEVICE

BACKGROUND OF THE INVENTION

1. Field of the Invention

This invention relates generally to an electrophotographic apparatus and more particularly to improvements of a roller for use in a liquid developing device for developing an electrostatic latent image and in a rinsing device for rinsing a developer.

2. Description of the Prior Art

Heretofore, liquid developing devices for electrophotography have been classified into two types of systems. One is a system for immersing an electrostatic recording paper or recorder such as a photosensitive member or the like formed with an electrostatic latent image thereon in a developing liquid. The other is a system for contacting a developing roller adhered with a developing liquid to a recording medium formed with an electrostatic latent image. In the so-called wet type developing device of the latter type employing a developing roller such as described in Japanese Patent Publication No. 18,993/1965 and U.S. Pat. No. 3,500,793, grooves are formed on the surface of a developing roller or yarn is wound around the roller to enhance the carrying effect of developing liquid.

Although the conventional developing roller of the latter type achieves considerable carrying effect of the developer, it is almost impossible to uniformly contact the respective portions of the developing roller, which is rotating with respect to the electrostatic latent image surface of the moving recording medium, so as to always maintain the developing electrode effect uniform. Accordingly, it has been very difficult to obtain preferable pictures of good contrast.

Moreover, there are other commonly known problems in the conventional liquid developing system. If, for example, the toner concentration of the developer used is increased, adherence of the toner to the non-electrostatic image portion of the recording medium is increased and the fogging density is simultaneously increased. In color copying, where the developing treatments are repeated several times, the effect of fogging density becomes large. New developments of this technique are, therefore, desirable since the prevalence of electrophotographic developing devices of this type has increased.

SUMMARY OF THE INVENTION

The present invention is, therefore, intended to eliminate the foregoing difficulties in the prior art and to provide improved and novel developing and rinsing devices for an electrophotographic apparatus.

The object of the present invention is to provide an improved roller for use in a developing device which is also usable in a rinsing device for electrophotographic apparatus.

A further object of the present invention is to provide an electrophotographic apparatus in which a uniform concentration of developer or rinsing liquid will be supplied to the developing section or the rinsing sections, respectively, in developing or rinsing devices.

Another object of the present invention is to provide developing and/or rinsing devices for electrophotographic apparatus in which the contacting surface of the roller with the recording medium will be increased so as to supply a great deal of liquid to the surface of the recorder.

Another object of the invention is to provide developing and/or rinsing devices for electrophotographic apparatus in which the interval between the developing roller or the rinsing roller and the recording medium is easily adjustable in accordance with copying conditions.

Still another object of the invention is to provide developing and/or rinsing devices for electrophotographic apparatus in which deterioration of the developed image due to the friction of the roller may be greatly reduced to thus provide high quality pictures.

Another object of the invention is to provide an electrophotographic apparatus capable of developing or rinsing with high speed.

To attain the above objects, the improved roller of the developing device and/or the rinsing device according to the present invention comprises a stationary magnetic member including a plurality of magnetic poles, a non-magnetic rotatable member arranged around the magnetic member and adapted to rotate along the outer periphery of the magnetic member, and a magnetic brush of magnetic particles or resin coated magnetic particles formed on the outer surface of the rotatable member. The device further comprises an agitating plate for removing low concentration developer or removing rinsing liquid having toner and a cutting blade for adjustably cutting the tips of the magnetic brush.

DETAILED DESCRIPTION OF THE PREFERRED EMBODIMENTS

Figure 1:
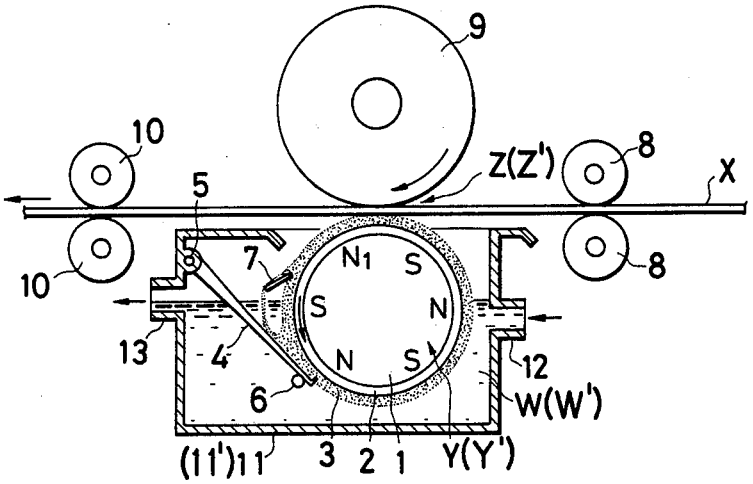
FIG. 1 shows the essential parts of a first embodiment of the electrophotographic developing device according to the present invention, partly in fragmentary view.

The various preferred embodiments of this invention will now be described with reference to the accompanying drawings. For convenience of description, the same or equivalent components of the respective embodiments are designated by the same reference numerals and characters.

The present invention may be used in both the developing unit and in the rinsing device of electrophotographic copying machines. Since the developing unit embodying this invention corresponds to the rinsing device, the explanation of the developing unit will also be applicable to the rinsing device.

In FIG. 1, only the essential parts of a first embodiment of the developing unit of this invention are shown partly in fragmentary view. Reference numeral 1 represents a stationary roller magnetic member which includes a plurality of magnetic poles for forming a magnetic brush wherein N and S signify magnetic poles normally used heretofore. Cylindrical member 2, which is made of a non-magnetic material such as aluminum, brass or the like, surrounds the magnetic member 1 and rotates around the outer periphery thereof.

Magnetic brush 3 is formed of reduced iron particles of high electroconductivity to enhance the developing electrode effect on the surface of the non-magnetic rotatable member 2 surrounding the magnetic member 1. The developing roller Y of this invention comprises the magnetic member 1, the non-magnetic rotatable member 2 and the magnetic brush 3, and is partly immersed in a developing solution W. The solution W is contained in a tank 11 and is maintained at substantially constant level by the supply and exhaust of the solution to and from the tank 11 via the supply port 12 and the outlet 13.

Reference numeral 4 illustrates a magnetic brush tip cutting blade rotatably supported at one end by a shaft 5 at the inner wall of the tank 11. The cutting blade 4 is adjusted at an interval from the roller Y by a movable rod 6 arranged at the back of the other end of blade 4 for adjustably cutting the tips of the brush 3 to adjust the thickness of the brush as shown in FIG. 1. There is no cutting when the magnetic brush 3 is not in use. A magnetic brush tip agitating plate 7 is adjustably arranged at an interval from the roller Y similarly to the blade 4 for removing low concentration developer which has accumulated on the surface of the magnetic brush so as to drop the reduced iron powder scraped by the plate 7 onto blade 4 for reuse.

Reference numeral 8 indicates a pair of feed rollers made of resin or rubber, etc. for feeding a recording medium X to the developing section Z. Pressure roller 9 depresses the recording medium X onto the magnetic brush 3 of the roller Y forming the developing section. A pair of squeeze rollers 10 are arranged so that the one normally contacted with the developing surface is made of a polished metallic roller plated with chromium and the other roller is made of rubber for removing the developer retained on the recording medium X after developing treatment.

The main magnetic pole $N_1$ of the magnetic member 1 is formed at the pole nearest to the pressure roller 9. The main pole $N_1$ employs the strongest magnetic force when compared with the other poles N, S, such as 1,400 gausses on the surface of the rotatable member 2. The magnetic particles of reduced iron powder forming the magnetic brush 3 are thus prevented from moving to the recording medium X in the developing section Z so as to avoid the powder from adhering thereto.

The operation of the developing unit thus constructed is as follows. When the rotatable member 2 of the roller Y is rotated and the other respective rollers 8, 9 and 10 are simultaneously operated to feed the recording medium X, the latter is depressed onto the magnetic brush 3 containing the developing solution W by the roller 9 for developing treatment. The recording medium X thus treated is then squeezed by the rollers 10 and is carried out of the developing unit. The portion of the magnetic brush 3 which has finished the developing treatment is agitated by the plate 7 and is adjusted by the tips of the blade 4. The adjusted portion of the brush 3 is immersed in the developing solution W and continuously moved toward the developing section Z by the rotation of the non-magnetic member 2 for new developing treatment.

Alternatively, for use in a rinsing device instead of the developing unit, the developing roller Y, the developing solution W and the developer tank 11 are replaced, respectively, by a rinsing roller Y', a rinsing liquid W' and a rinsing liquid tank 11'. Since this arrangement corresponds to developing unit as described with respect to FIG. 1 above, a separate drawing for this embodiment is omitted.

The construction of the rinsing device may be stated briefly as follows. The rinsing roller Y' is also composed of the stationary magnetic roller member 1, the non-magnetic rotatable member 2 and the magnetic brush 3 as in the embodiment of the developing unit of FIG. 1. The roller Y' is partly immersed in a rinsing liquid W' contained in a rinsing liquid tank 11' to and from which the liquid W' is supplied via a supply port 12 and is exhausted via an outlet 13. The main magnetic pole $N_1$ having the strongest magnetic force is formed at the pole of the magnetic member 1 nearest the rinsing section Z'.

The operation of the rinsing device thus constructed is similar to the embodiment of the developing unit of FIG. 1. When the rotatable member 2 of the roller Y' is rotated and other rollers 8, 9 and 10 are simultaneously operated to feed the recording medium X after the execution of the developing treatment, the recording medium X is depressed onto and is rubbed by the magnetic brush 3 containing a great deal of rinsing liquid at the rinsing section Z'. The recording medium is then squeezed and carried out of the rinsing device by the rollers 10. The portion of the magnetic brush 3 which has finished the rinsing treatment is agitated and adjusted by the plate 7 and the blade 4, respectively, and is then continuously moved towards the rinsing section Z' in accordance with the rotation of the non-magnetic rotatable member 2 through the rinsing solution for re-rinsing treatment.

It should be understood from the foregoing description that when a developing unit and a rinsing device are constructed and operated according to the present invention, the following features and advantages are obtained:

(a) When the developer solution is carried by the magnetic brush 3 to the developing section Z and the electrostatic latent image surface of the recording medium X is depressed by the pressure roller 9 onto the magnetic brush 3, the contacting surface (rubbing width) of the brush 3 with the recording medium X is increased, for example, about 1 to 2 cm in the rotating direction thereof. Since the developer W contained in the brush 3 is spread from the brush 3 to the recording medium X, a great deal more of the developer W compared with conventional developing units can be supplied to the electrostatic latent image surface of the recording medium X to enhance the developing effect.

(b) In the rinsing device, as in the developing device, when the rinsing liquid W' is carried by the magnetic brush 3 to the rinsing section Z' and the picture surface of the recording medium X developed is depressed by the pressure roller 9 onto the magnetic brush 3, the contacting surface of the magnetic brush 3 with the recording medium X is thus increased, for example, about 1 to 2 cm in the rotating direction thereof. Since the rinsing liquid W' contained in the brush 3 is spread from the brush 3 to the recording medium X, a great deal more of the rinsing liquid W' compared with conventional rinsing devices can be supplied to the picture surface of the recording medium X to enhance the rinsing effect.

(c) Since the magnetic brush 3 is contacted with the recording medium X, the deterioration of the developed image due to the friction is greatly reduced compared with conventional rollers to thus provide a higher picture quality.

(d) Developer or rinsing liquid of uniform concentration can be supplied by the magnetic brush 3 utilizing the agitating plate 7 and the cutting blade 4 since the interval between the magnetic brush 3 and the recording medium X can be easily adjusted. Uniform contacting of the magnetic brush 3 with the recording medium X is thus achieved in accordance with copying conditions.

(e) Since the main magnetic pole $N_1$ has the strongest magnetic force to prevent the magnetic particles forming the brush 3 from moving to the electrostatic latent image surface and to adhere to the picture surface of the recording medium X, a high quality picture image can be thus obtained.

(f) Since the aforementioned advantages listed in the above paragraphs a, b, c, d and e mutually act to produce better results, the developing unit or the rinsing device embodying this invention can greatly accelerate the developing speed or the rinsing speed, respectively, than heretofore obtained by the conventional devices.

(g) When a development was performed by this invention, there was provided 1.0 to 1.2 of reflecting density and less than 0.05 of fogging density at 0.1 second of developing time with 150 volts of surface potential of the electrostatic recording sheet.

Figure 2:
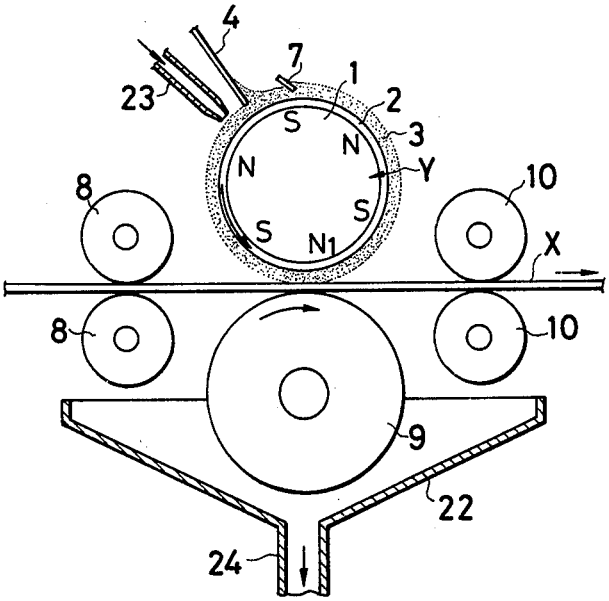
FIGS. 2, 3 and 4 are diagrammatical views showing other embodiments according to this invention, also partly in fragmentary view.

FIG. 2 shows another embodiment of this invention. The developing roller Y, pressure roller 9 and the squeeze rollers 10 are arranged vertically reverse to the first embodiment shown in FIG. 1. A developer solution supply nozzle 23 is arranged at the rear of the magnetic brush tip cutting blade 4 instead of in the developer tank 11. A developer reservoir 22 having a developer outlet 24 provided at the bottom thereof is located below the recording medium X.

It is to be noted that although the developing roller Y and the pressure roller 9 are formed as a pair in the aforementioned first and second embodiments of this invention, several developing rollers Y can also be used with one pressure roller 9 or both can also be provided in several pairs. Since almost all the advantages of the first embodiment and second embodiment can thus be obtained, further description of these modifications will be omitted.

The first embodiment was constructed to develop with a monochrome toner of the developer W using one set of the developing roller Y and the pressure roller 9. In a third embodiment of this invention shown in FIG. 3, a drum 19 is employed instead of the pressure roller 9 and an electrostatic recording sheet or recording medium X composed of a photosensitive member is provided thereto. Various different developer solutions $W_1$, $W_2$, $W_3$, and $W_4$ are separately supplied to separate developer tanks 21, 31, 41 and 51, respectively. The respective developer solutions have different toners and the recording medium X is sequentially developed by the respective developing rollers Y of the respective tanks 21, 31, 41 and 51. Since the advantages of this embodiment are substantially the same as those of the first and second embodiment of FIGS. 1 and 2, detailed description is not necessary.

Figure 3:
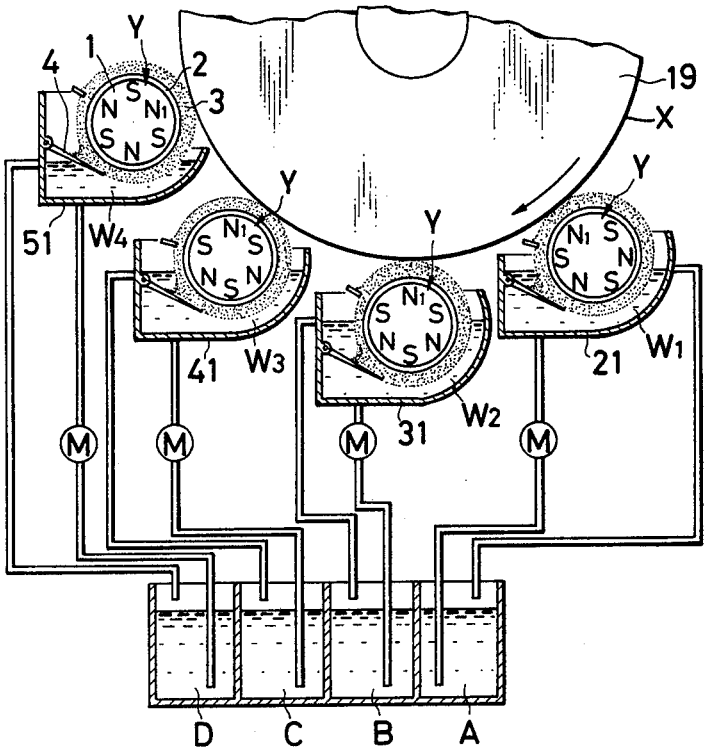

In FIG. 3, reference characters A, B, C and D represent the storage tanks for the respective developers and M represents the pumps associated with the tanks. If the magnetic brush 3 associated with each of the developing rollers Y arranged respectively in the tanks 21, 31, 41 and 51 is cut by the blade 4 attached thereto, the developer in that tank will not be used.

Figure 4:
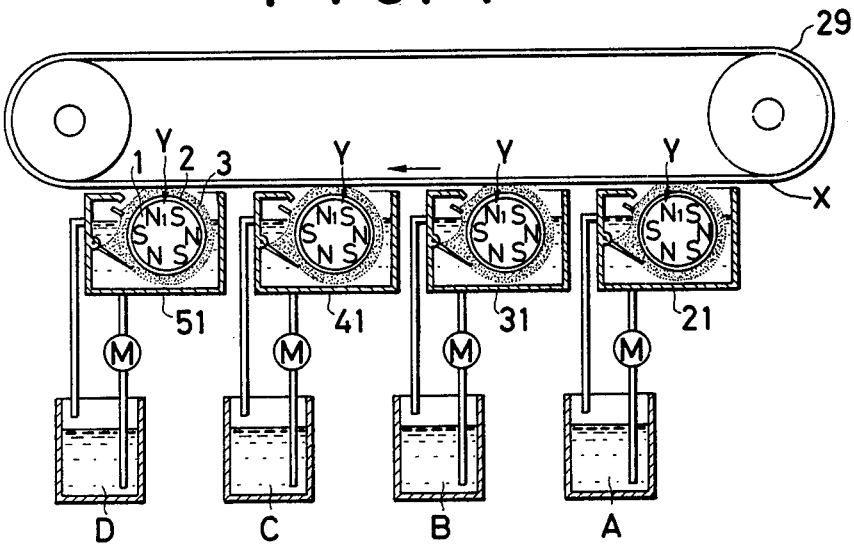

In the fourth embodiment shown in FIG. 4, a conveyor 29 is provided instead of the drum 19 of the third embodiment of this invention for supporting the recording medium X thereon. The other constitution is entirely the same as the third embodiment with the result that the advantages of this embodiment is also the same as the third embodiment.

I claim:

1. In an electrophotographic apparatus, a device for developing or rinsing an electrostatic image bearing surface with a liquid at a contact zone wherein said liquid is brought into contact with said image bearing surface only at said zone, comprising:

at least one roller comprising a stationary magnetic member having a plurality of magnetic poles located at predetermined positions around periphery of said magnetic member, a non-magnetic cylindrical member surrounding said stationary magnetic member and adapted to rotate along the outer periphery of said magnetic member, and a magnetic brush of magnetic particles formed on the surface of the rotatable non-magnetic member for carrying the liquid to the contact zone;

an agitating plate located downstream of the contact zone and adjustably arranged at an interval from the roller for scraping the magnetic brush after it has been rotated past the contact zone to remove liquid from the surface of said magnetic brush;

a cutting blade located downstream of said agitating plate and arranged at an adjustable interval from the roller for adjusting the thickness of the magnetic brush; and means for imbuing the adjusted portion of the magnetic brush with said liquid located downstream from said cutting blade so that liquid of substantially uniform concentration is brought into contact with the electrostatic image bearing surface at the contact zone by rotation of the non-magnetic member.

2. An electrophotographic apparatus according to claim 1, wherein said imbuing means comprises a vessel containing said liquid, said vessel being arranged so that the adjusted portion of the magnetic brush is immersed in the liquid.

3. An electrophotographic apparatus according to claim 1, wherein said imbuing means comprises a nozzle through which said liquid is supplied to the adjusted portion of the magnetic brush.

4. An electrophotographic apparatus according to claim 1, wherein one of said plurality of magnetic poles of the stationary magnetic member is located nearest to the contact zone and has a stronger magnetic force than the other magnetic poles.

5. An electrophotographic apparatus according to claim 2, further comprising a plurality of said rollers for developing the same electrostatic image bearing surface and a separate vessel associated with each said roller, each said vessel containing a different liquid developer in which is immersed the adjusted portion of the magnetic brush associated with each respective roller.

6. An electrophotographic apparatus according to claim 5, wherein said electrostatic image bearing surface is supported on the outer periphery of a rotatable drum.

7. In an electrophotographic apparatus according to claim 1, wherein said liquid is a liquid developer for developing said image bearing surface.

8. In an electrophotographic apparatus according to claim 1, wherein said liquid is a rinsing liquid for rinsing said image bearing surface after development.

* * * * *